US008776744B2

(12) United States Patent
Bayrakdar

(10) Patent No.: US 8,776,744 B2
(45) Date of Patent: Jul. 15, 2014

(54) CAMSHAFT ADJUSTING ASSEMBLY

(75) Inventor: Ali Bayrakdar, Rothenbach/Pegnitz (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 130 days.

(21) Appl. No.: 13/505,056

(22) PCT Filed: Oct. 28, 2010

(86) PCT No.: PCT/EP2010/066329

§ 371 (c)(1),
(2), (4) Date: Apr. 30, 2012

(87) PCT Pub. No.: WO2011/051377

PCT Pub. Date: May 5, 2011

(65) Prior Publication Data

US 2012/0210963 A1 Aug. 23, 2012

(30) Foreign Application Priority Data

Oct. 31, 2009 (DE) ..... 10 2009 051 519

(51) Int. Cl.
*F01L 1/34* (2006.01)

(52) U.S. Cl.
USPC ..... 123/90.17

(58) Field of Classification Search
CPC ..... F01L 2001/34433; F01L 1/3442; F01L 2001/0475; F01L 2001/0476; F01L 2001/3443
USPC ..... 123/90.15, 90.17
See application file for complete search history.

(56) References Cited

U.S. PATENT DOCUMENTS

| | | | | |
|---|---|---|---|---|
| 6,363,896 | B1 * | 4/2002 | Speier | 123/90.17 |
| 2002/0148423 | A1 * | 10/2002 | Speier | 123/90.17 |
| 2005/0051123 | A1 * | 3/2005 | Haser et al. | 123/90.17 |
| 2005/0103294 | A1 * | 5/2005 | Heinze et al. | 123/90.17 |
| 2007/0095315 | A1 * | 5/2007 | Hoppe et al. | 123/90.17 |
| 2007/0204824 | A1 * | 9/2007 | Strauss et al. | 123/90.17 |
| 2008/0236529 | A1 * | 10/2008 | Scheidig et al. | 123/90.17 |
| 2008/0264200 | A1 * | 10/2008 | Hoppe et al. | 74/568 R |
| 2009/0145386 | A1 * | 6/2009 | Ushida | 123/90.17 |
| 2009/0159024 | A1 * | 6/2009 | Paul et al. | 123/90.15 |

FOREIGN PATENT DOCUMENTS

| | | |
|---|---|---|
| DE | 19654926 | 11/1997 |
| DE | 19944535 | 1/2001 |
| DE | 102005041393 | 3/2007 |
| DE | 102005052481 | 5/2007 |
| WO | 2009005999 | 1/2009 |

* cited by examiner

*Primary Examiner* — Thomas Denion
*Assistant Examiner* — Jorge Leon, Jr.
(74) *Attorney, Agent, or Firm* — Volpe and Koenig, P.C.

(57) ABSTRACT

A camshaft adjustment assembly (1), wherein a control valve (4) is provided for controlling the flow of the pressure fluid in the hydraulic chamber, wherein the control valve (4) is supplied with pressure fluid from the region of a camshaft bearing (5) by a fluid channel (6, 7, 8, 9). In order to enable an improved fluid line with little component weakening, the fluid channel (6, 7, 8, 9) is formed as an annular chamber (6), which is formed between the axial end (10) of the camshaft (2) at least sections of which have a tubular design, a flange-like section (11) of a housing element (12) that is connected rotationally fixed to the camshaft (2) and in which the control valve (4) is mounted, a radially inner delimiting surface (13) of the housing element (12), and a section (14) of the wall of the camshaft bearing (5).

11 Claims, 5 Drawing Sheets

CAMSHAFT ADJUSTING ASSEMBLY

FIELD OF THE INVENTION

The invention relates to a camshaft adjusting arrangement for varying the relative angular position of a camshaft with respect to a crankshaft of an internal combustion engine, wherein the camshaft adjusting arrangement comprises a drive element which is driven by the crankshaft and which is mounted so as to be rotatable relative to the camshaft, wherein between the drive element and the camshaft there are formed at least two hydraulic chambers which can be charged with a pressurized fluid in order to set a defined relative rotational position between the drive element and the camshaft, wherein a control valve is provided to control the flow of the pressurized fluid into the hydraulic chambers, wherein the control valve is supplied with pressurized fluid from the region of a camshaft bearing via a fluid channel.

BACKGROUND

Camshaft adjusting devices of said type are well known in the prior art, wherein reference is made by way of example to DE 10 2005 052 481 A1 and to DE 10 2005 041 393 A1. In the camshaft adjuster there is provided a vane wheel in which vanes are integrally formed or arranged. The vanes are situated in hydraulic chambers formed in an outer rotor. Through corresponding charging of the respective side of the hydraulic chambers with hydraulic fluid, an adjustment of the inner rotor relative to the outer rotor between an "early stop" and a "late stop" can be realized. Here, the flow of hydraulic oil is controlled by means of an electrically actuated directional control valve. The valve has a housing in which is formed a valve bore. A control piston can move in a displacement direction relative to the housing, for which purpose an electromagnetically actuated linear displacement unit is used. During operation of the internal combustion engine, the linear displacement element of the valve is acted on by the vehicle electrical or electronic system with a control current such that—as a function of the engine parameters—a desired camshaft adjustment or adjustment of the gas exchange valves is realized.

To control the movement, therefore, hydraulic fluid is conducted according to demand into the hydraulic chambers by means of the control valve. Here, the pressurized hydraulic oil is conducted by a hydraulic pump into the hydraulic chambers via the cylinder head and via the region of the camshaft bearing via the said fluid channel.

The following fact has proven to be disadvantageous: to produce the fluidic connection between the hydraulic pump and the control valve, according to the prior art, there are formed into the camshaft in the region of the camshaft bearing a turned groove and through bores, via which the pressurized fluid is conducted. Both the turned groove and the bores weaken the camshaft. Furthermore, the formation of the turned groove and through bores is cumbersome and entails corresponding machining costs. Furthermore, in the previous known design, the camshaft must be formed as a solid shaft, which has correspondingly disadvantageous consequences with regard to the weight of the camshaft.

SUMMARY

The present invention is based on the object of developing a camshaft adjusting arrangement of the type specified in the introduction in such a way as to make it possible to design the fluid channel in the region of the camshaft bearing, and the connection of said fluid channel to the further fluid path, such that the manufacture of the arrangement is made simpler and therefore cheaper. Furthermore, the need for machining the camshaft in the region of its connection to the camshaft adjuster, resulting in a reduction in its mechanical strength, should be eliminated. Finally, it should also become possible to resort to a hollow shaft as a camshaft.

The solution to meeting the object of the invention is characterized in that the fluid channel comprises an annular chamber which is formed between the axial end of the camshaft which is of tubular form at least in portions, a flange-like portion of a housing element which is rotationally fixedly connected to the camshaft and into which the control valve is installed, a radially inner delimiting surface of the housing element, and a portion of the wall of the camshaft bearing.

Here, the annular chamber is preferably of rectangular form in radial cross-section.

The control valve may comprise a central screw by means of which it is fixed in the housing element coaxially with respect to the camshaft.

The camshaft is preferably fastened directly to the housing element. Here, the fastening of the camshaft to the housing element is preferably realized by means of an interference fit between an internally cylindrical portion of the camshaft and a cylindrical portion of the housing element. The fastening may also be realized by means of a cohesive connection; which cohesive connection may be formed as a soldered connection, in particular as a brazed connection, or as a welded connection, in particular as a laser-welded or electron beam-welded connection.

The housing element may furthermore have an axial abutment surface for the axial end of the camshaft, so as to define for the camshaft a defined axial end position relative to the housing element.

The flange-like portion of the housing element however preferably forms an axial bearing surface for the camshaft bearing, as a result of which an axial bearing function for the camshaft is also provided.

The fluid channel for the pressurized fluid preferably comprises a plurality of bores which extend through the housing element, wherein the bores are preferably arranged at an angle of between 30° and 60° with respect to the axis of the camshaft.

With the provided design of the camshaft adjuster, it is possible, with the use of a central valve for controlling the pressurized fluid, for a tube to be used as a basic body for the camshaft at least in sections, which offers corresponding weight advantages.

Furthermore, it is possible to dispense with mechanical machining in the end region of the camshaft in the region of the camshaft bearing, such that not only are machining costs in this regard eliminated, but also the mechanical strength of the camshaft is maintained.

BRIEF DESCRIPTION OF THE DRAWINGS

Exemplary embodiments of the invention are illustrated in the drawings, in which.

DETAILED DESCRIPTION OF THE PREFERRED EMBODIMENTS

Figure 1:
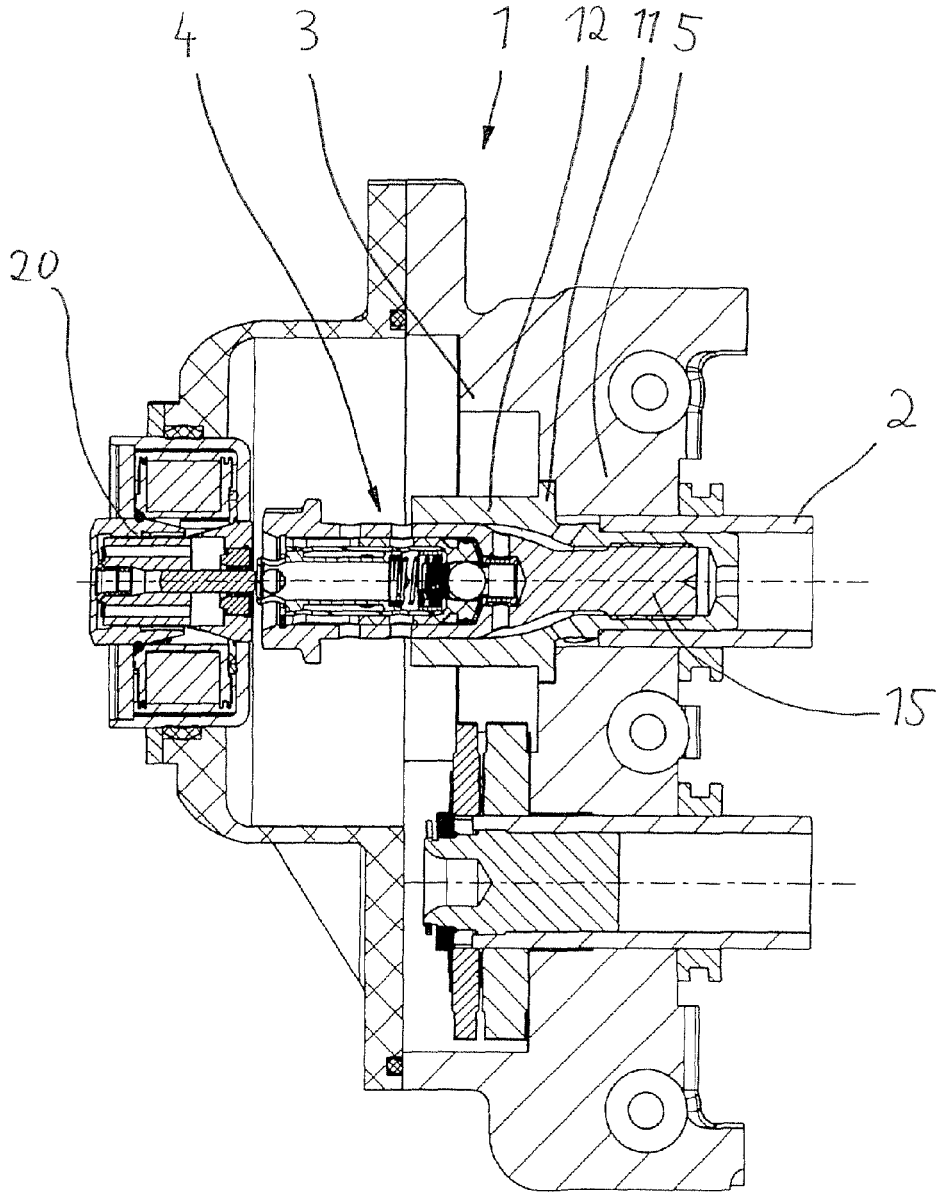
FIG. 1 shows the radial cross-section through a camshaft adjusting arrangement of an internal combustion engine, having a rudimentarily illustrated camshaft according to a first embodiment of the invention.
Figure 2:
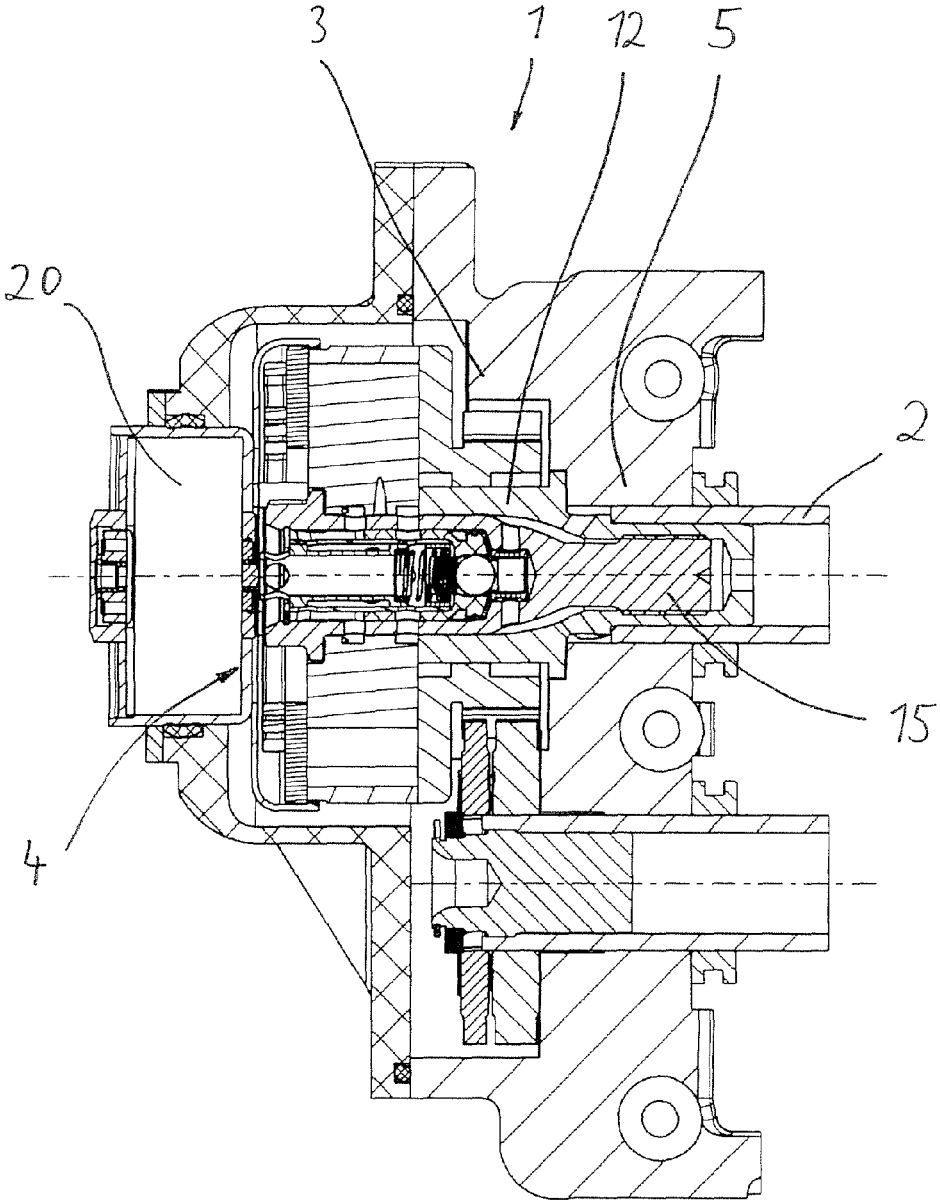
FIG. 2 shows, illustrated as per FIG. 1, an alternative embodiment of the camshaft adjusting arrangement according to a second embodiment of the invention.
Figure 3:
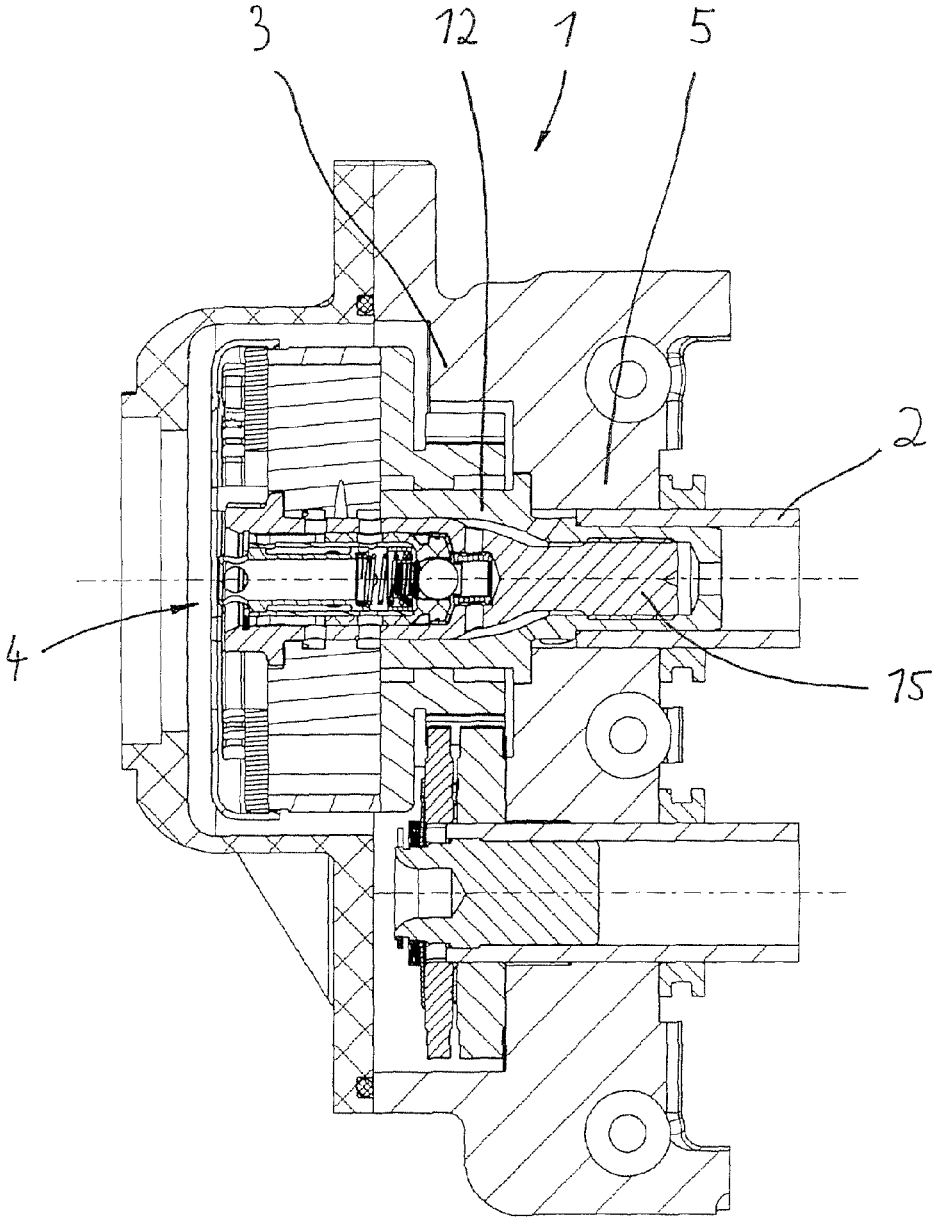
FIG. 3 shows, illustrated as per FIG. 1, a further alternative embodiment of the camshaft adjusting arrangement according to a third embodiment of the invention.
Figure 4:
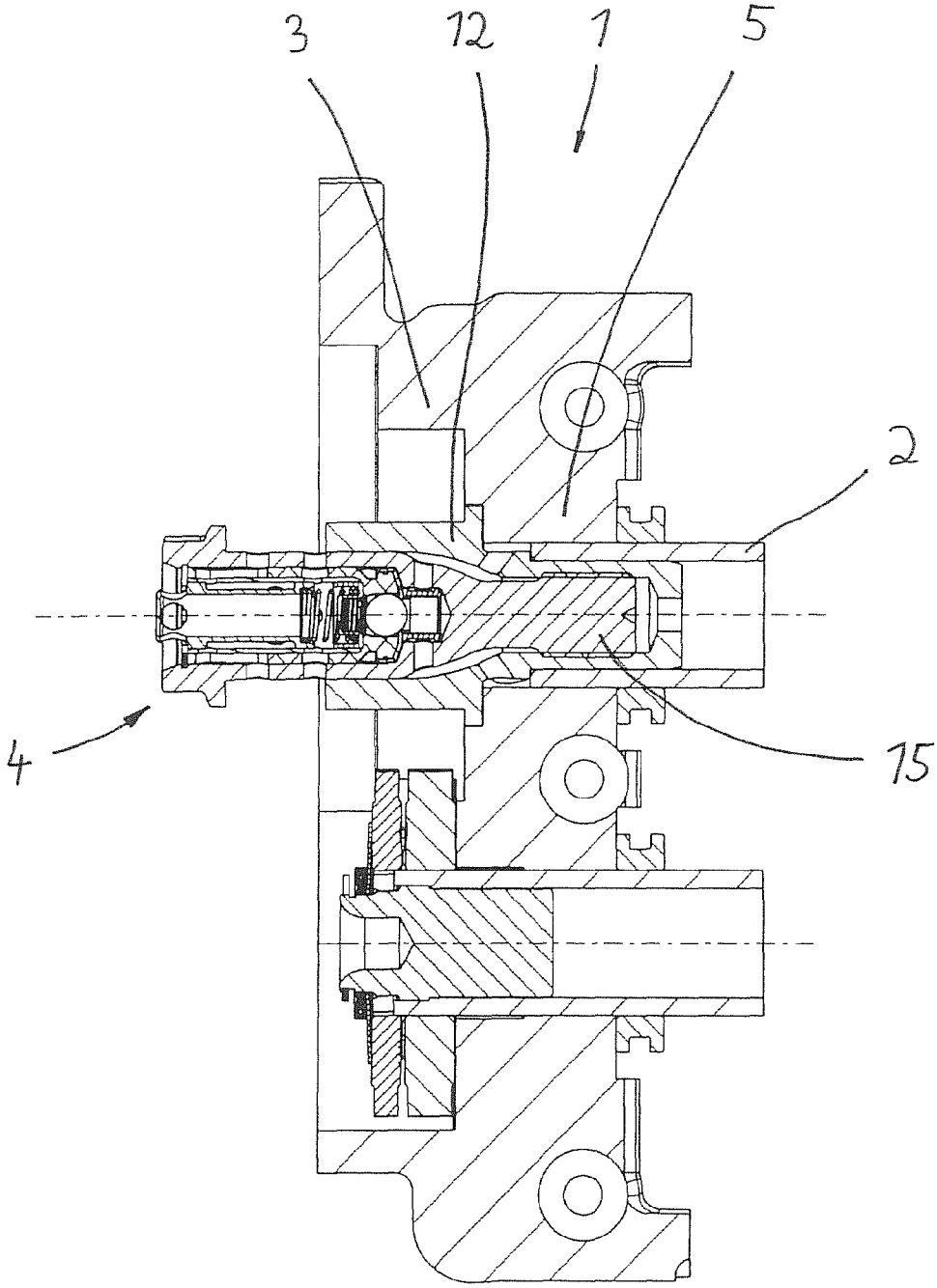
FIG. 4 shows, illustrated as per FIG. 1, a further alternative embodiment of the camshaft adjusting arrangement according to a fourth embodiment of the invention.

FIGS. 1 to 4 show four exemplary embodiments of the camshaft adjusting arrangement 1 according to the invention of an internal combustion engine, which ultimately differ merely in the manner of actuation of a control valve 4 which is required for conducting pressurized fluid in a targeted manner into hydraulic chambers (not illustrated) in order to perform a camshaft adjustment in a known way. The basic design and the mode of operation correspond to the Applicant's DE 10 2005 052 481 A1, to the entire content of which reference is made in this respect.

According to said document, the camshaft adjusting arrangement 1 has, via a traction element (not illustrated) which is usually a chain or a sprocket, a drive element 3 designed to perform a targeted rotation about a defined angle of relative rotation between the crankshaft of the internal combustion engine and a camshaft 2, so as to influence the operating characteristics of the internal combustion engine in a known way. The flow of pressurized hydraulic fluid into the hydraulic chambers is effected by means of a control valve 4 which is actuated, by being displaced in the axial direction (corresponding to the axial direction of the camshaft 2), counter to the action of a spring by an actuating unit 20.

Figure 5:
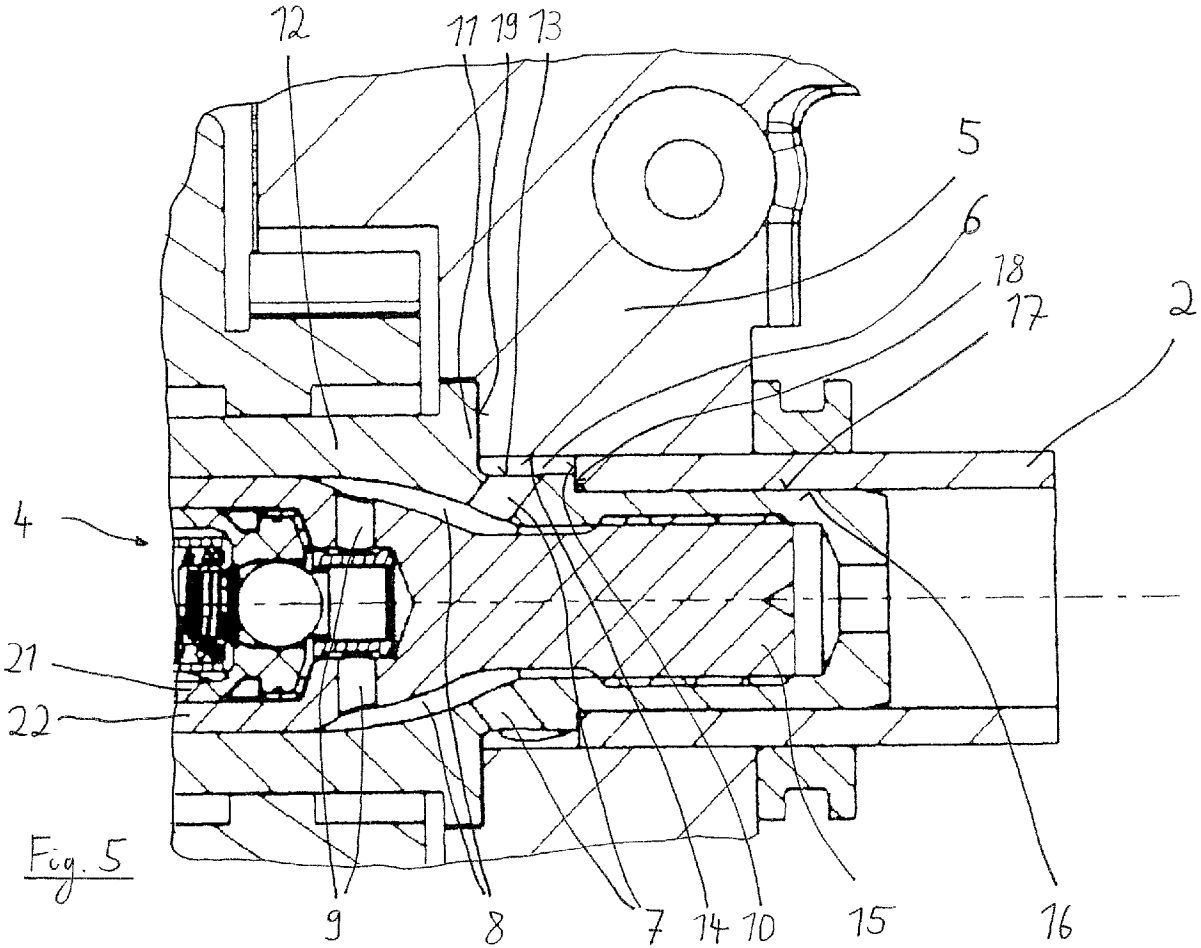
FIG. 5 shows the region of the control valve together with camshaft shoulder and camshaft bearing in an enlarged illustration.

The control valve 4 is composed of a pressure medium guide insert 21 (in this regard, see the detail view in FIG. 5) which is seated in an axially displaceable manner in a control valve 22. The control valve 22 is in turn fixedly arranged in a housing element 12, which functions as an adapter. For this purpose, the control valve 22 has a central screw 15 which is screwed into a thread in the housing element 12.

With regard to the mode of operation of the camshaft adjusting arrangement 1, reference is again made to DE 10 2005 052 481 A1.

What is essential is that the pressurized fluid for actuating the camshaft adjusting arrangement 1 must be conducted from a pump (not illustrated) to the pressure medium guide insert 21 via the region of a camshaft bearing 5. The camshaft bearing 5 serves for mounting the camshaft 2 such that the latter is rotatable relative to the camshaft bearing 5 and therefore also relative to the drive element 3.

For conducting the pressurized fluid, a fluid channel is provided which has the portions 6, 7, 8 and 9. The portion 7 is comprised of a plurality of, for example three or four, bores which are formed into the housing element 12 at an angle with respect to the axis of the camshaft 2. There is then formed between the housing element 12 and the control valve 22 an annular chamber 8 via which the fluid is conducted onward. Into the control valve 22 there are then formed transverse bores 9 via which the pressurized fluid passes to the pressure medium guide insert 21.

In the present case, what is crucial is the design of the first fluid channel 6 which produces the connection between a pressure line (not illustrated), which is connected to the fluid pump, and the fluid channel 7.

The annular chamber 6 is designed such that, to form said annular chamber, it is not necessary for the camshaft 2 to be mechanically machined and thereby weakened. The camshaft 2 is in the present case formed as a tube which has an axial end 10. The housing element 12 has, in its (right-hand) axial end region, a cylindrical portion 17 which, at a step, forms an axial abutment surface 18 for the end 10 of the camshaft 2. The camshaft 2 in turn has an internally cylindrical portion 16 which is pushed onto the cylindrical portion 17 until the end 10 of the camshaft 2 bears against the axial abutment surface 18.

Here, the housing element 12 and the camshaft 2 are permanently connected, for example by means of a welded or soldered connection. Furthermore, it may alternatively or additionally be provided that there is an interference fit between the cylindrical portion 17 of the housing element 2 and the internally cylindrical portion 16 of the camshaft 2, such that the fixed connection between the camshaft 2 and housing element 12 is produced in this way. A positively locking connection (for example by means of a thread) between the housing element 12 and camshaft 2 would also be possible.

The housing element 12 furthermore has a flange-like portion 11 with a radially extending side surface which simultaneously forms an axial bearing surface or run-on surface 19 for the camshaft bearing 5. The two radially running surfaces formed by the axial end 10 of the camshaft 2 and by the axial bearing surface 19 on the housing element 12 form the lateral delimiting surfaces of the fluid channel 6 which has an annular chamber form.

The radial delimiting surfaces of this fluid channel are formed by a radially inner cylindrical delimiting surface 13, which is formed in the outer circumference of the housing element 12, and by a cylindrical part of the wall 14 of the camshaft bearing 5.

Accordingly, in the present case, there is formed as a fluid channel an annular chamber 6 which has a rectangular shape in radial cross-section.

The advantage of this embodiment is firstly that a tube can be used as a camshaft 2 without problems, since the connection to the housing element 12 can, as explained, be realized in a space-saving and advantageous manner. Furthermore, the camshaft 2 itself need not be mechanically machined in order to create the fluid channel 6. In the prior art, it was hitherto necessary for recesses to be formed into the camshaft for this purpose, which not only entails corresponding manufacturing outlay, but also results in mechanical weakening of the camshaft 2.

LIST OF REFERENCE NUMERALS

1 Camshaft adjusting arrangement
2 Camshaft
3 Drive element
4 Control valve
5 Camshaft bearing
6 Fluid channel
7 Fluid channel
8 Fluid channel
9 Fluid channel
10 Axial end of the camshaft
11 Flange-like portion
12 Housing element
13 Radially inner delimiting surface
14 Portion of the wall of the camshaft bearing
15 Central screw
16 Internally cylindrical portion of the camshaft

17 Cylindrical portion of the housing element
18 Axial abutment surface
19 Axial bearing surface for the camshaft bearing
20 Actuating unit
21 Pressure medium guide insert
22 Control valve

The invention claimed is:

1. A camshaft adjusting arrangement for varying a relative angular position of a camshaft with respect to a crankshaft of an internal combustion engine, the camshaft adjusting arrangement comprises a drive element which is driven by the crankshaft and which is mounted so as to be rotatable relative to the camshaft, between the drive element and the camshaft there are formed at least two hydraulic chambers which are charged with a pressurized fluid in order to set a defined relative rotational position between the drive element and the camshaft, the camshaft has a tubular axial end supported in a camshaft bearing, a control valve including a valve housing and a movable control spool is provided to control a flow of the pressurized fluid into the hydraulic chambers, the control valve is supplied with pressurized fluid directly from a region of a camshaft bearing via a fluid channel, the fluid channel comprises an annular chamber which is defined by an axial end face of the tubular axial end of the camshaft, a flange portion of a housing element which is rotationally fixedly connected to the camshaft and into which the control valve is installed, a radially inner delimiting surface of the housing element, and a portion of a wall of the camshaft bearing.

2. The camshaft adjusting arrangement as claimed in claim 1, wherein the annular chamber has a rectangular form in radial cross-section.

3. The camshaft adjusting arrangement as claimed in claim 1, wherein the control valve comprises a central screw by which it is fixed in the housing element coaxially with respect to the camshaft.

4. The camshaft adjusting arrangement as claimed in claim 1, wherein the camshaft is fastened to the housing element.

5. The camshaft adjusting arrangement as claimed in claim 4, wherein the fastening of the camshaft to the housing element is realized by an interference fit between an internally cylindrical portion of the camshaft and a cylindrical portion of the housing element.

6. The camshaft adjusting arrangement as claimed in claim 4, the fastening of the camshaft to the housing element is realized by a cohesive connection.

7. The camshaft adjusting arrangement as claimed in claim 6, wherein the cohesive connection is formed as a soldered connection, a brazed connection, or a welded connection.

8. The camshaft adjusting arrangement as claimed in claim 1, wherein the housing element has an axial abutment surface for the axial end of the camshaft.

9. The camshaft adjusting arrangement as claimed in claim 1, wherein the flange portion of the housing element forms an axial bearing surface for the camshaft bearing.

10. The camshaft adjusting arrangement as claimed in claim 1, wherein the fluid channel for the pressurized fluid comprises a plurality of bores which extend through the housing element.

11. The camshaft adjusting arrangement as claimed in claim 10, wherein the bores are arranged at an angle of between 30° and 60° with respect to an axis of the camshaft.

* * * * *